US010207834B2

(12) United States Patent
Beck

(10) Patent No.: US 10,207,834 B2
(45) Date of Patent: Feb. 19, 2019

(54) METHOD AND APPARATUS FOR AUTOMATICALLY WRAPPING UTENSILS IN A NAPKIN

(71) Applicant: Michael Beck, Blaine, MN (US)

(72) Inventor: Michael Beck, Blaine, MN (US)

( * ) Notice: Subject to any disclaimer, the term of this patent is extended or adjusted under 35 U.S.C. 154(b) by 902 days.

(21) Appl. No.: 14/271,724

(22) Filed: May 7, 2014

(65) Prior Publication Data

US 2015/0321775 A1 Nov. 12, 2015

(51) Int. Cl.

| | |
|---|---|
| ***B65B 11/08*** | (2006.01) |
| ***B65B 51/08*** | (2006.01) |
| ***B65B 49/12*** | (2006.01) |
| ***A47G 21/16*** | (2006.01) |
| ***B65B 51/06*** | (2006.01) |
| ***B65B 11/04*** | (2006.01) |

(52) U.S. Cl.

CPC ..... *B65B 49/12* (2013.01); *A47G 21/16* (2013.01); *B65B 11/04* (2013.01); *B65B 11/08* (2013.01); *B65B 51/06* (2013.01); *B65B 51/08* (2013.01)

(58) Field of Classification Search

CPC ..... B65B 51/08; B65B 11/08; B65B 11/00; B65B 11/10; B65B 11/16; B65B 11/04; B65B 11/56; B65B 27/10; B65B 27/105

USPC ..... 53/210, 211, 215, 216, 203, 147, 148

See application file for complete search history.

(56) References Cited

U.S. PATENT DOCUMENTS

| | | | | |
|---|---|---|---|---|
| 3,956,109 | A | 5/1976 | Dietsche | |
| 5,365,723 | A * | 11/1994 | Ramos | B65B 11/045 53/211 |
| 5,469,688 | A * | 11/1995 | Dunbar | B65B 63/04 53/419 |
| 5,655,663 | A | 8/1997 | Spradlin | |
| D396,866 | S | 8/1998 | Carl | |
| 5,996,809 | A | 12/1999 | Chiasson | |
| 6,023,908 | A * | 2/2000 | Vetsch | B65B 11/04 53/155 |
| 6,023,913 | A * | 2/2000 | Gray | B65B 11/105 53/154 |
| 6,202,387 | B1 * | 3/2001 | Brown | B65B 11/105 156/538 |
| 6,615,566 | B2 * | 9/2003 | Heisey | B65B 11/105 53/206 |
| 6,837,028 | B1 | 1/2005 | Miano et al. | |

(Continued)

*Primary Examiner* — Thanh Truong
*Assistant Examiner* — Thomas Wittenschlaeger
(74) *Attorney, Agent, or Firm* — Westman, Champlin & Koehler, P.A.; Amanda M. Prose

(57) ABSTRACT

An apparatus and method for automatically rolling a napkin around a set of dining utensils, wherein the apparatus can repeat the method quickly to individually wrap a plurality of sets of utensils in napkins. The apparatus comprises a housing for a first transfer unit for receiving a set of unwrapped utensil and a napkin and configured to automatically deliver the unwrapped utensils and napkin to a platform for wrapping. A lift plate holds a plurality of napkins and delivers a single napkin to unwrapped silverware. A rolling assembly rotatable around the unwrapped utensils and the napkin is configured to hold the utensils and to roll the napkin around the unwrapped utensils and to deliver the wrapped utensils to a second transfer unit configured to provide the wrapped utensils to a bin for storage.

8 Claims, 10 Drawing Sheets

(56) References Cited

U.S. PATENT DOCUMENTS

| | | | | |
|---|---|---|---|---|
| 6,918,226 | B2 * | 7/2005 | Heilman | B65B 11/04 53/203 |
| 7,210,279 | B1 * | 5/2007 | Ahmed | B65B 11/02 53/155 |
| 7,322,172 | B2 * | 1/2008 | Hoffman | A47J 36/027 53/155 |
| 7,913,478 | B2 * | 3/2011 | Lavi | B65B 11/02 53/155 |
| 8,820,036 | B2 * | 9/2014 | Collins | B65B 25/14 53/116 |
| 8,973,340 | B2 * | 3/2015 | Weaver | B65B 11/02 53/203 |
| 9,446,870 | B1 * | 9/2016 | Cameron | B65B 11/16 |
| 2004/0237475 | A1 * | 12/2004 | Rubin | B65B 11/00 53/461 |
| 2008/0282877 | A1 * | 11/2008 | De Villiers | F41G 3/16 89/41.17 |

* cited by examiner

10

24

METHOD AND APPARATUS FOR AUTOMATICALLY WRAPPING UTENSILS IN A NAPKIN

FIELD OF THE INVENTION

This invention relates to a device for automatically wrapping a napkin and securing the wrapped napkin around a set of utensils.

BACKGROUND OF THE INVENTION

The bar and restaurant service industry requires tables to be cleaned and reset quickly for customers. In many casual dining establishments, a goal is to provide quick and efficient dine-in service. Many of these dining establishments utilize silverware, or rather, reusable utensils, which reduces waste. Moreover, in many of these establishments, the types of food served cannot be comfortably eaten or cut for eating when using disposable or plastic utensils. To further efficiently provide utensils in a clean manner, many of these establishments provide the utensils pre-wrapped with a napkin when setting a table for customers or diner use.

In preparation for efficient meal service, reusable utensils (i.e. flatware or silverware including knives, forks and/or spoons) must be cleaned and prepared for diners' use. Most restaurants prepare these utensils for diners' use in large quantities and in advance of busier meal times. The utensils are generally provided along with napkins. The prior art includes devices for folding a plurality of flat materials, such as napkins, and examples of these devices are described in U.S. Pat. Nos. 4,002,331 and 4,349,185. When tables are cleaned and re-set between diners, it is more efficient for the restaurant to provide common utensils, a knife and fork, and occasionally a spoon, pre-wrapped in a napkin. Thus, when re-setting a table, the person setting simply grabs enough wrapped utensils per the seats at the table.

The prior art also includes automatic devices limited to sorting utensils using a variety of bulky and inefficient methods including liquid reservoirs for sorting utensils by buoyancy as described in U.S. Pat. No. 5,655,663; or the incorporation of vibrating beds to move individual utensils for sorting based on the size or shape of a barrier as described in U.S. Pat. No. 3,956,109. Prior art methods of moving and sorting utensils are also described in U.S. Pat. No. 5,996,809 and include the use of belts having grasping mechanisms and magnetic members to retrieve individual utensils from a bin holding a plurality of utensils.

Utensils are generally wrapped in a napkin and such preparation is completed manually, by hand rolling. Employees must hand-roll a knife and fork or other utensils, together in a napkin and secure the wrapped utensils in a pre-adhered paper napkin ring. Employees must take a clean knife and fork from separate bins, place them together with a napkin and roll the napkin around the utensils. Many employees may work on this never-ending task during slow times or before a restaurant opens or after the restaurant closes each day. This task is labor intensive and slow.

SUMMARY OF THE INVENTION

The present disclosure relates to an apparatus for automatically and quickly rolling a napkin around utensils and securing the napkin. The apparatus comprises an upper transfer unit for receiving a set of unwrapped utensils and a napkin. The upper transfer unit is configured to automatically deliver the set of unwrapped utensils and the napkin to a rolling unit for wrapping. The apparatus also comprises a lift plate for storing a plurality of napkins, the lift plate is configured to automatically deliver the napkin to the upper transfer unit. The rolling unit is configured to hold the utensils and to fold and roll the napkin around the unwrapped utensils. Once the rolling unit has rolled the napkin around the utensils, the utensils are wrapped and secured in the napkin with a paper band which has pre-adhered adhesive. The apparatus also comprises a lower transfer unit for automatically receiving wrapped utensils from the rolling unit, the lower transfer unit is configured to automatically dispense and place the wrapped utensils into a storage receptacle.

The present disclosure also relates to a method of automatically rolling and securing a napkin around a set of utensils and dispensing the wrapped set of utensils into a container for storage. The method includes steps which are completed automatically and the steps comprise delivering selected utensils into a first, upper transfer unit and providing a napkin to the first, upper transfer unit. The method further includes the steps of positioning the first, upper transfer unit over a wrapping unit and dispensing the selected utensils and napkin from the first, upper transfer unit onto the wrapping platform wherein rotating a first bar moves a first corner of the napkin over the utensils and secures the utensils and napkin to the wrapping platform and rotating a second bar to wrap the napkin completely around the utensils. The method also includes removing the wrapped utensils from the wrapping platform. The method is repeatable in order to quickly and sequentially wrap a plurality of sets of utensils in a plurality of napkins.

DETAILED DESCRIPTION OF THE INVENTION

The apparatus of the present invention is a device for automatically wrapping a set of utensils in a napkin by rolling the napkin around selected utensils, generally a pair of utensils including a knife and/or fork and securing the napkin. The apparatus also dispenses the rolled, or napkin wrapped utensils into a receptacle for orderly storage. The automatic napkin roller of the present invention is a self-contained and movable unit. The apparatus generally includes a loading receptacle for unwrapped utensils and napkins, an upper transfer unit, a rolling unit for wrapping the napkin around the utensils, and a lower transfer unit, all of which are configured to cooperate to receive a utensil or a set of utensils, automatically roll the selected utensils in a napkin, secure the napkin as rolled around the utensils and dispense the napkin wrapped utensils into a storage receptacle. The process is repeated in sequence to automatically wrap a plurality of individual sets of utensils in napkins in a short amount of time. The apparatus is computer controlled and wrapping can be initiated automatically or manually.

Figure 1:
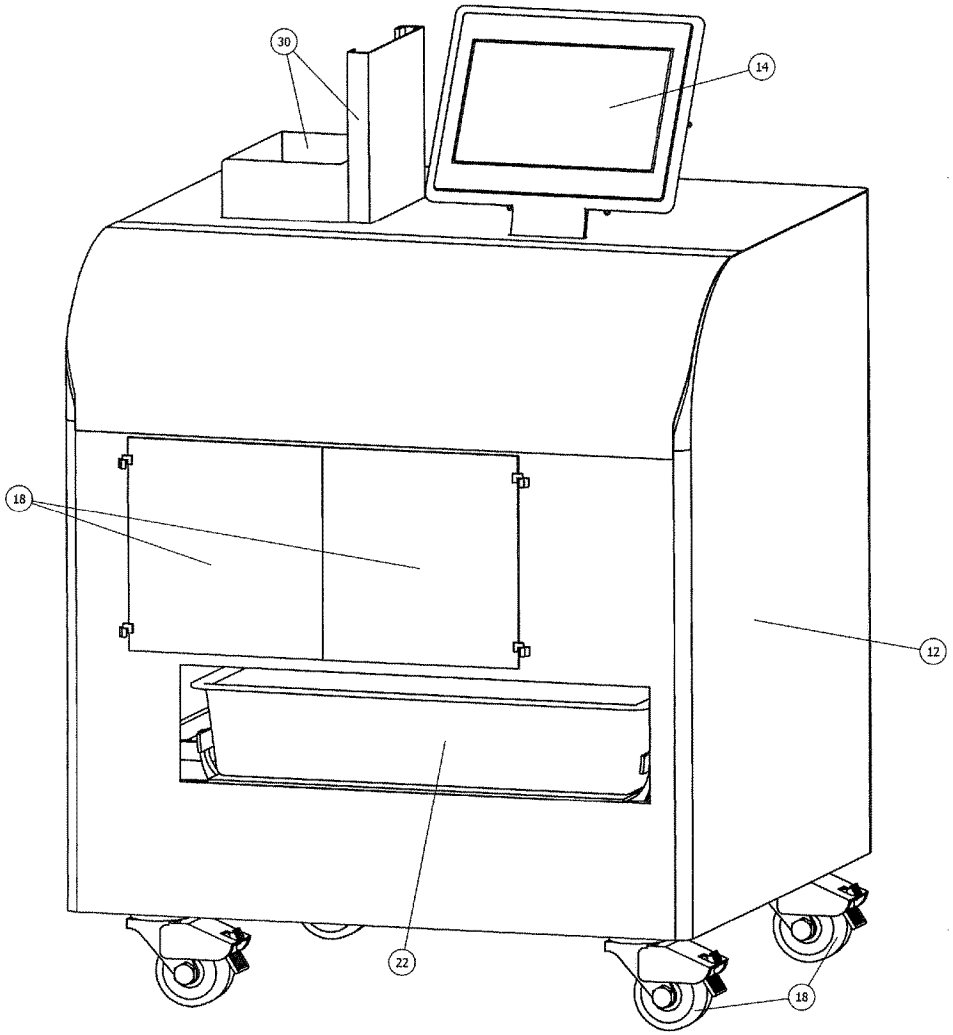
FIG. 1 is a perspective view of an apparatus of the present invention.
Figure 2:
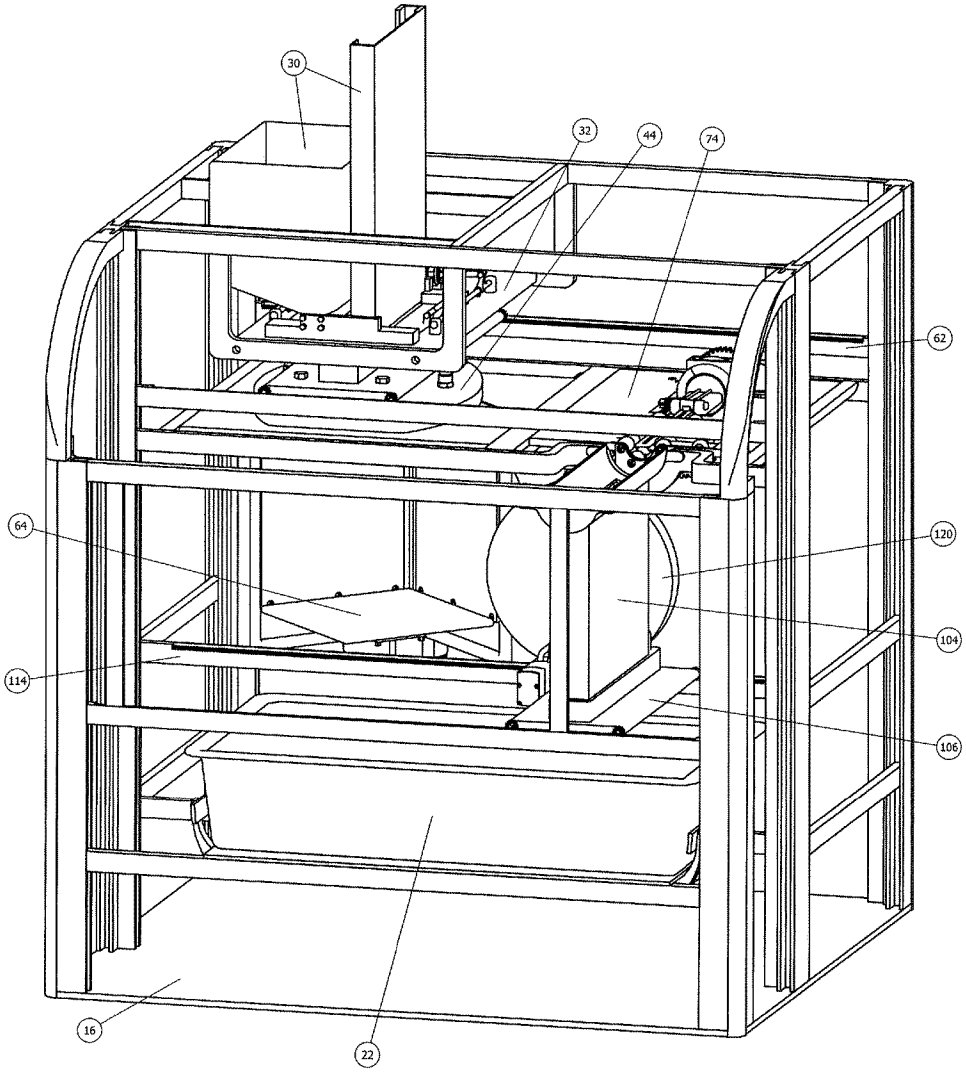
FIG. 2 is an internal perspective view of the apparatus of the present invention.

As illustrated generally in FIG. 1 at 10, the apparatus includes a housing 12 and a control system 14. The housing 12 may be an aluminum, or other lightweight yet durable casing, to which all components are secured to and/or within. The housing 12 has two openings; one of which is accessible via doors 20 which provides access to the wrapping components of the apparatus and ease of access for servicing the components, as well as filling the napkins 118 and securing bands 120. The second opening allows access to the wrapped utensil storage receptacle 22. Moreover, the apparatus 10 is portable within a restaurant or other setting for use. A bottom plate 16 of the housing 12 is secured to casters 18 for uninhibited rolling of the apparatus. The apparatus 10 can be stored in a back area or moved out of the way when not in use.

Figure 7:
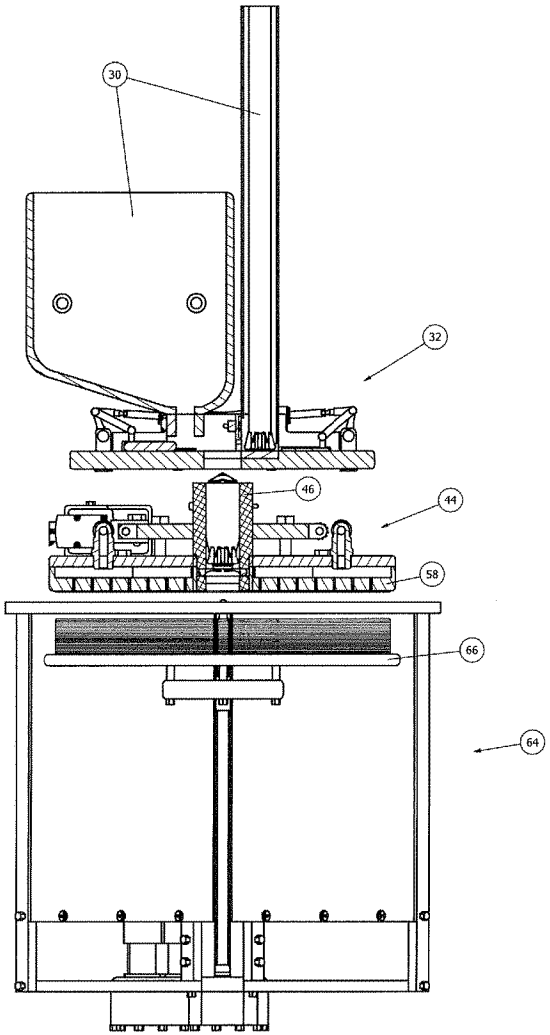
FIG. 7 is a cross-sectional view of an upper transfer loading area of the present invention.
Figure 8:
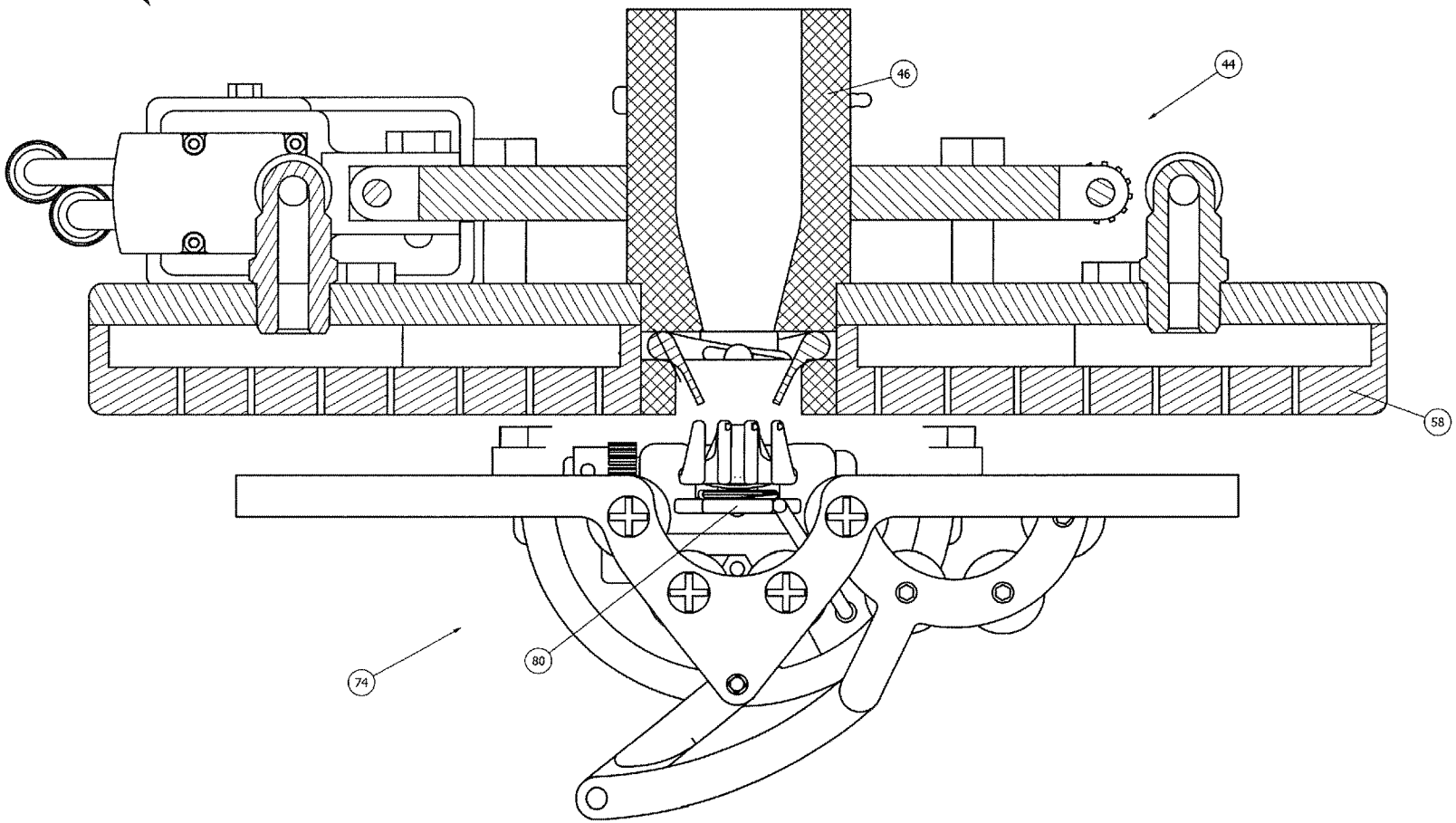
FIG. 8 is a cross-sectional view of an upper transfer unloading area and rolling area of the present invention.

The automatic utensil roller 10 has a loading position 24 for the upper transfer unit 44 as illustrated in FIG. 7, which is located between the utensil dispensing unit 32 and the napkin lift unit 64. The upper transfer unit 44 is movable, from a loading position 24, to a dispensing position 26 directly over the rolling unit 74 as illustrated in FIG. 8. A utensil loading receptacle 30 is positioned above the utensil dispensing unit 32 and holds the unwrapped utensils 116 prior to initiating the wrapping process. The utensils 116, generally knives and forks may be held in separate receptacles 30 prior to wrapping. A napkin lift unit 64 is generally located below the utensil dispensing unit 32, which also happens to be in the loading area 24 of the upper transfer unit 44.

Figure 10:
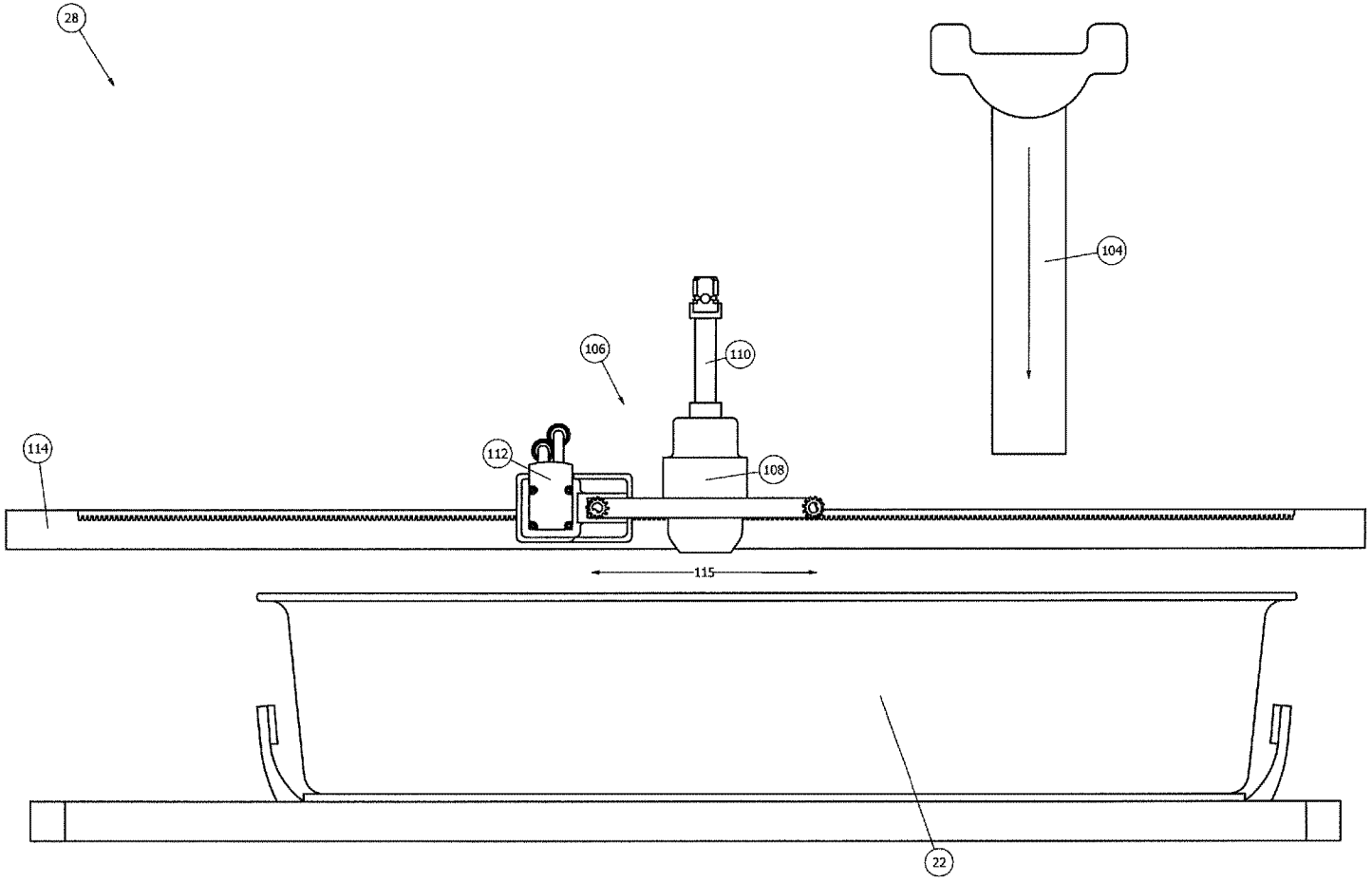
FIG. 10 is a cross-section view of the wrapped utensil storage area of the present invention.

The upper transfer unit 44 is configured to automatically receive unwrapped utensils 116 in the loading area 24 from the loading receptacle 30 via the utensil dispensing unit 32, and a napkin 118 from the napkin lift unit 64 and to move the utensils 116 and napkin 118 to the rolling area 26 for wrapping. Once the napkin 118 has been rolled around the utensils 116 and secured with a band 120, the wrapped utensils 122 are then released from the rolling area 26, or more precisely from the rolling unit 74, into a wrapped utensil area 28 as illustrated in FIG. 10. The wrapped utensil area 28 also positions the wrapped utensils 122 into a wrapped utensil storage receptacle 22 via the lower transfer unit 106.

Figure 3A:
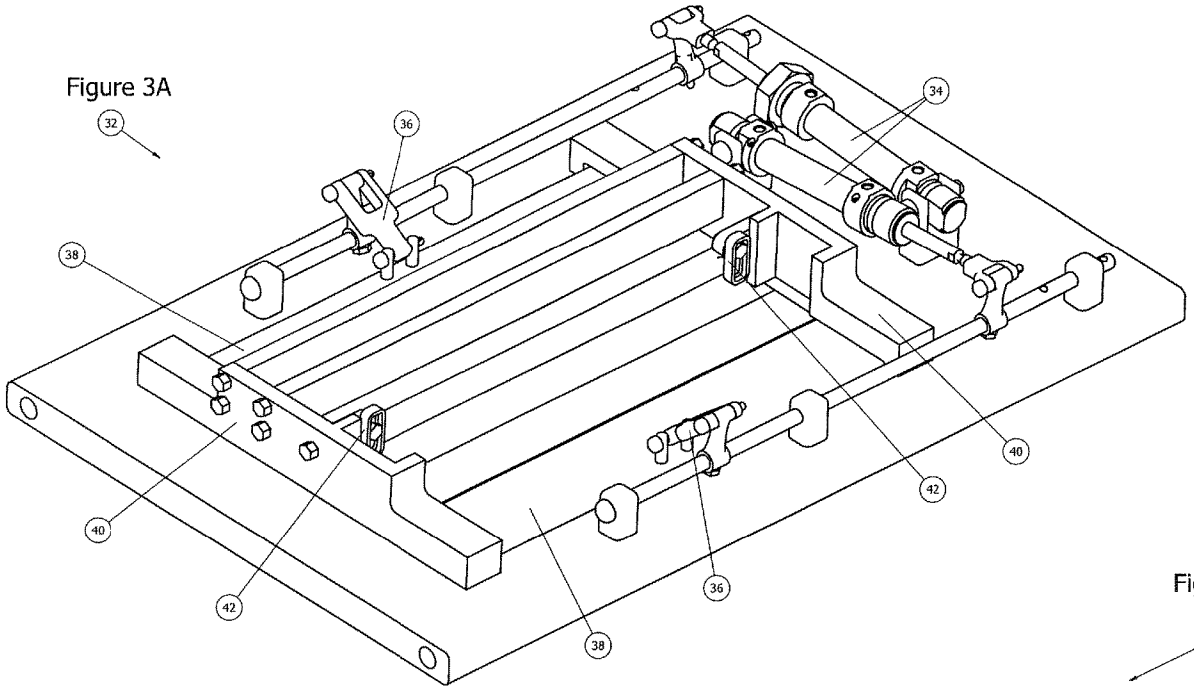
FIG. 3A is a perspective view of a utensil dispenser unit of the apparatus of the present invention.
Figure 3B:
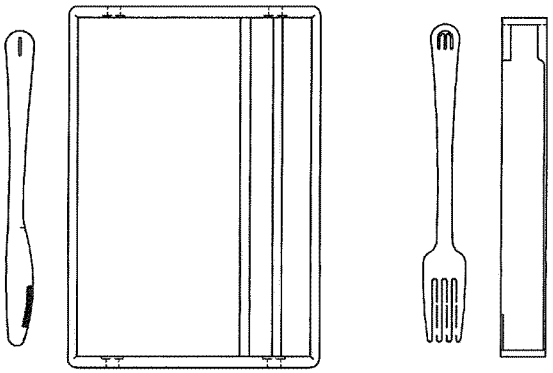
FIG. 3B is a top view of storage containers for the utensil dispensing unit and further illustrating an orientation of individual utensils in respective storage containers of the present invention.

As further illustrated in FIGS. 3 and 7, a utensil dispensing unit 32 is positioned below the utensil loading receptacle 30 and removes a single utensil 116 of the set of utensils 116 for wrapping and moves the respective utensil 116 to the upper transfer loading area 24. The selected utensils 116, usually a knife followed by a fork, and occasionally a spoon, fall into the upper transfer holding tube 46 which is position in the center of the upper transfer unit 44. The utensil dispensing unit 32 is a plate 38, which is slid by a pneumatic piston and/or solenoid 34 via a lever 36. Once the plate 38 is slid to a retracted position, the plate 38 is secured in a retracted position, by being held to the dispensing unit 32 by a plate guide 40. When in the extended position, the plate 38 acts to eject a selected utensil 116 from a bottom of a stack of like utensils 116 stored in the receptacle 30. The utensil dispenser 32 is also adapted with a utensil alignment bar 42 on the unit in which the plate 38 can be adjusted to accommodate utensils 116 of various sizes and shapes.

Figure 4B:
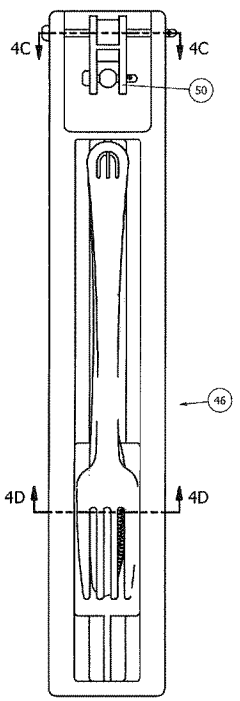
FIG. 4B is a top view of a holding tube as illustrated in FIG. 4A and illustrating utensil alignment according to the present invention.
Figure 4D:
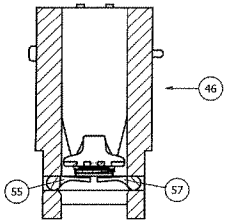
FIG. 4D is an internal front view of the holding tube as illustrated in FIG. 4B and illustrating proper utensil placement of the present invention.

The utensils 116 for wrapping are then released into the holding tube 46 in the upper transfer unit 44 as illustrated in more detail in FIGS. 4B and 4D. The holding tube 46 has a floor that may comprise a plate or doors 55 and 57 which holds the utensils 116 while loading. When loading the first set of unwrapped utensils 116 into the upper transfer holding tube 46, the upper transfer unit 44 is positioned in a first position. The first position is a loading position 24 and is illustrated in FIG. 7. The upper transfer unit 44 is then movable along a track 62 between the first position and a second position, the second position being substantially above or over the rolling unit 74, and the second position being a dispensing position 26 as illustrated in FIG. 8. The upper transfer unit 44 is movable by a motor driven gear 60 to drive the upper transfer unit 44 along the track 62. The bottom of the upper transfer unit 44 is further adapted such that a bottom plate 58 is a suction plate 58. A vacuum is generated between the napkin 118 for rolling and the suction plate 58, such that the suction plate 58 removes the first napkin 118 for wrapping the first set of utensils 116 from the napkin lift unit 64. The suction plate 58 is adapted with holes or other apertures, to allow vacuum suction to hold the napkin 118 to a surface of the suction plate 58.

Figure 5B:
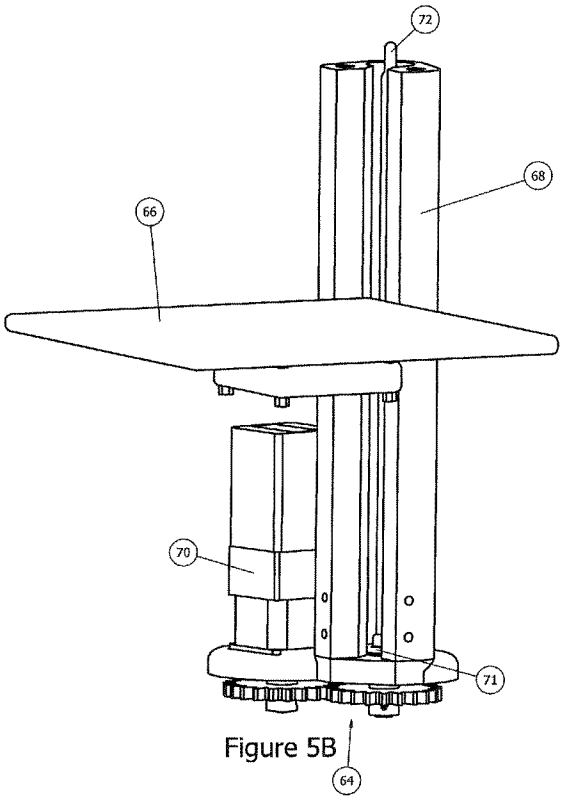
FIG. 5B is a perspective view of a napkin lift as illustrated in FIG. 5A of the present invention.
Figure 5A:
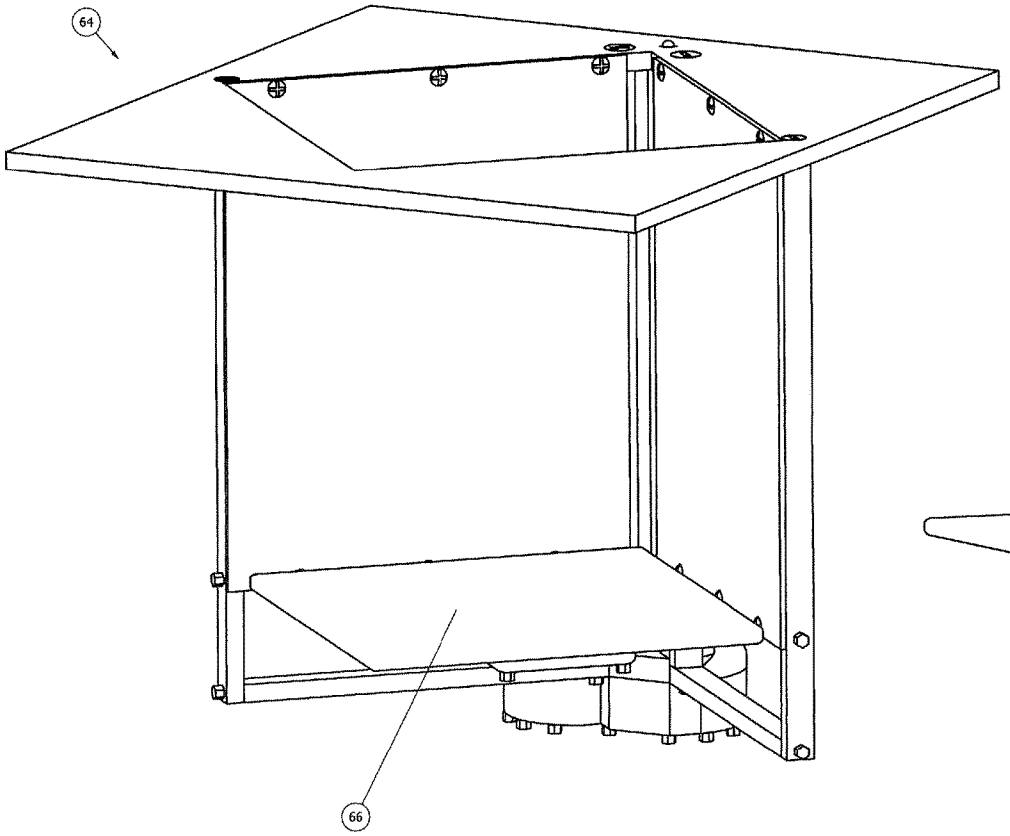
FIG. 5A is a perspective view of a napkin platform unit of the apparatus of the present invention.

As illustrated in further detail in FIGS. 5A and 5B, a napkin lift unit 64 holds a supply of napkins 118 and is movable from a first position, a holding position, to a second position, a dispensing position. The napkin lift unit 64 is a slide mounted plate 66. The plate 66, or napkin platform, can be moved or lifted along a length of the slide 68 from a first to the second position, wherein a first napkin 118 in the supply is lifted to a suction plate 58 and removed from the napkin lift unit 64. The plate, or napkin platform 66 is then lowered to back to the first position. The napkin platform 66 is raised and lowered, from the first position to the second position, by a motor driven gear 70 connected to a screw drive 72 resting on a bearing 71 in the napkin lift slide 68.

With the utensils 116 held in the upper transfer holding tube 46 and the napkin 118 suctioned to the suction plate 58, the upper transfer unit 44 is then automatically moved to a second position 24 which is a dispensing position and is substantially above and proximate to the rolling unit 74 as illustrated in FIG. 8. The utensils 116 are then released from the holding tube 46 onto the rolling unit 74. The weight of the utensils 116 when released onto the napkin 118 also releases the napkin 118 from the vacuum connection with the suction plate 58 so that the set of utensils 116 and the napkin 118 are released onto the roller tongue 80 which is inside the rolling unit 74.

In further detail, the mechanism used to release the utensils 116 and napkin 118 onto the rolling unit 74 is a rocker 50 which is rotated by an extending piston and/or solenoid 48 such that the rotating rocker 50 moves a slide 52 from a first position to a second position, which rotates a first and second sway bar 54 and 56 and pins. As the rotating sway bars 54 and 56 open the drop doors 55 and 57 and the utensils 116 and the napkin 118 are then loaded in or released on to the rolling tongue 80 inside the rolling unit 74. The rotating drop doors 55 and 57 also adjust the utensils 116 inside the upper transfer holding tube 46, such that the utensils 116 are centered and aligned with respect to one another and the napkin 118, and can be configured so that preferably, the fork is positioned on top of the knife which is further defined in FIGS. 4B and 4D. The upper transfer unit 44 is then cleared from the dispensing position 26, and moved back to the first position, the loading position 24.

As illustrated in FIG. 8, at the dispensing and/or rolling area 26, the utensils 116 as positioned on the napkin 118 will be wrapped in the napkin 118 via the rolling unit 74. The rolling unit 74 includes a rolling platform 76 which is adapted with a rolling assembly, in which all components cooperate to wrap the napkin 118 around the utensils 116 and to eject the wrapped utensils 122 off the rolling unit 74. The wrapped utensils 122 are then transported from the rolling area 26 to the dispensing area 28 via the wrapped utensil chute 104.

Figures 6A, 6B:
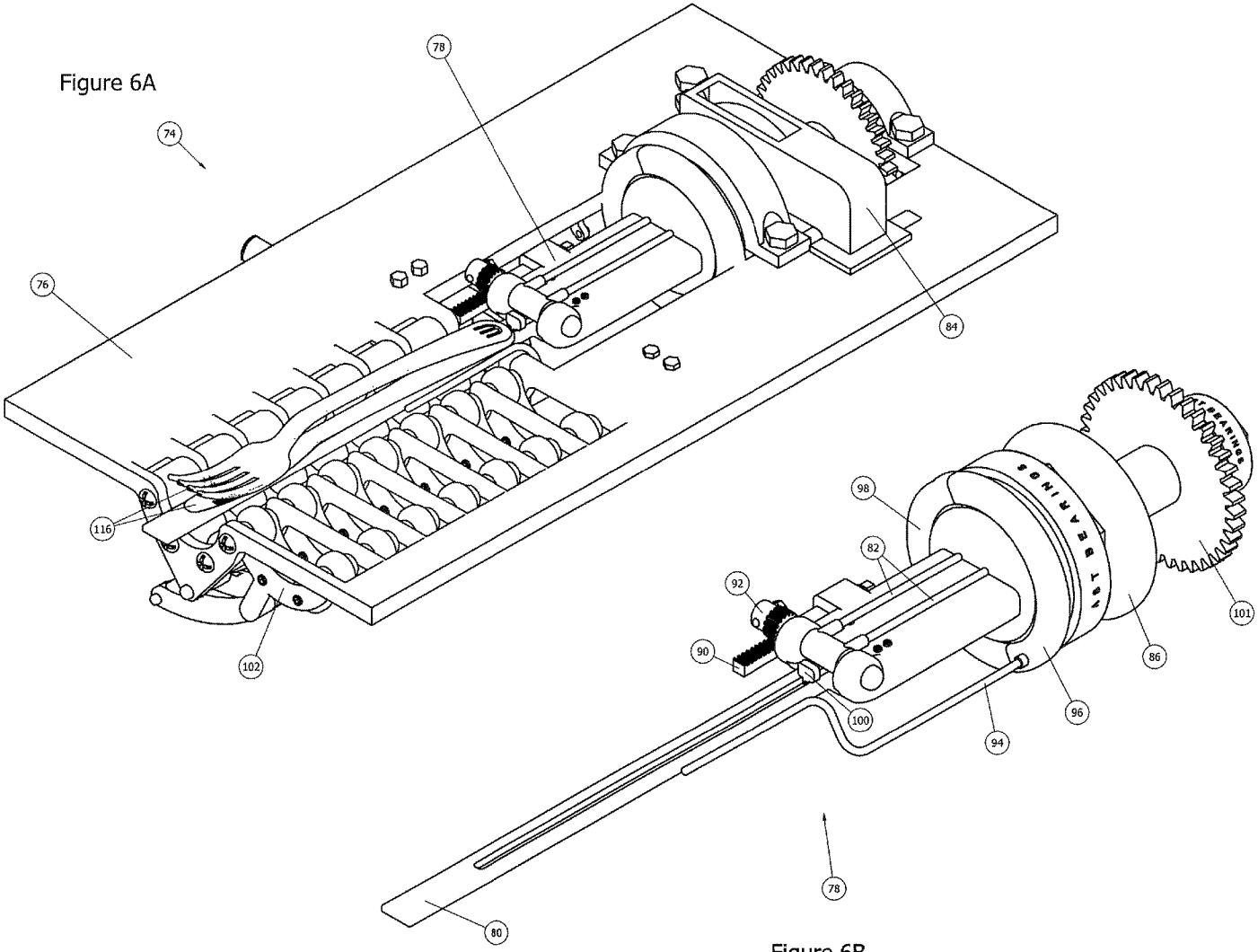
FIG. 6A is a perspective view of a rolling unit of the apparatus of the present invention.
FIG. 6B is a perspective view of a rolling shaft as illustrated in FIG. 6A of the present invention.

FIG. 6A illustrates the rolling unit 74, which includes key components and assemblies permitting the wrapping process to occur; the platform 76, a rotatable rolling shaft 78, and rolling arms 102. The platform 76 holds the rotatable rolling shaft 78 which holds three (3) sub-assemblies; a first fold bar 82, a second fold bar 94 and an ejector piston 100. The sub-assemblies of the rolling shaft 78 are illustrated in further detail in FIG. 6B. Further, the rolling shaft 78 includes a roller tongue 80 and a drive gear 101 positioned proximate the rear of the rolling shaft 78 to rotate the rolling shaft 78 in the rolling unit 74. The sub-assemblies of the rolling shaft 78 are generally positioned within the inside diameter of a bearing 103, in which the rolling shaft 78 is able to rotate freely. The rolling unit 74 also includes seven (7) rolling arms 102, which engage around the rolling shaft 78 to keep the napkin 118 pressed tightly around the utensils 116 while the rolling shaft 78 is rotating.

Figures 9A, 9B, 9C, 9D:
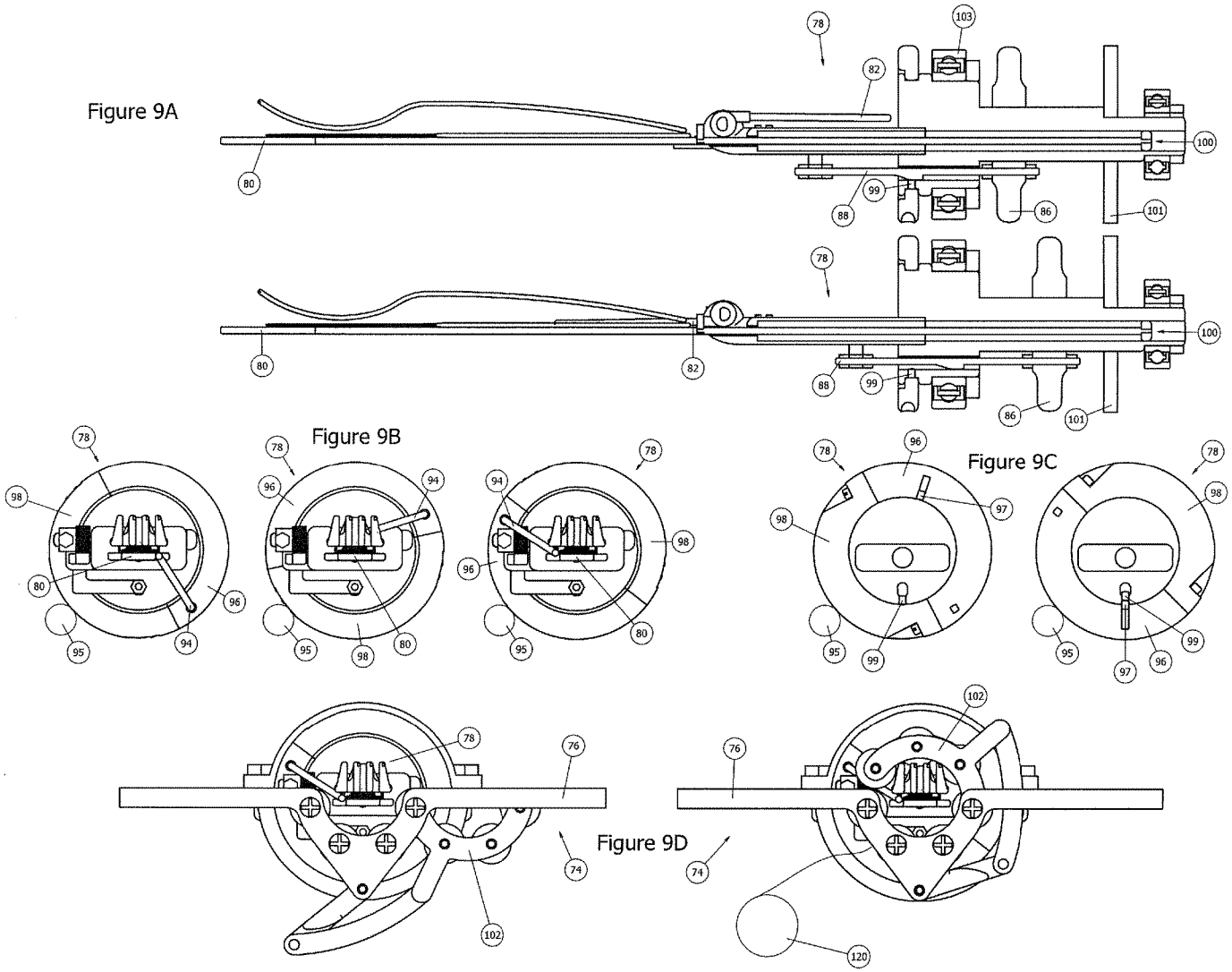
FIG. 9A is an illustrated side view of the wrapping process of the 1st fold bar as illustrated in FIG. 6B of the present invention.
FIG. 9B is an illustrated front view of the wrapping process of the 2nd fold bar as illustrated in FIG. 6B of the present invention.
FIG. 9C is an illustrated front view of the locking system of the 2nd fold bar as illustrated in FIG. 9B.
FIG. 9D is an illustrated front view of the wrapping process of the roller arms and band placement as illustrated in FIG. 6A of the present invention.

After the napkin 118 and utensils 116 are placed on the rolling unit 74, the components of the rolling shaft 78 cooperate to wrap the utensils 116 and wrapping is initiated by movement of the first fold bar 82, as illustrated in FIG. 9A. Prior to initiation of wrapping the napkin 118, the first fold bar 82 is positioned adjacent a back end of the utensils 116 with the back end of the utensils 116 pushed up against the ejector plate 100. The first fold bar 82 is rotatable by a slide guide 84 to catch a first corner or bottom edge of the napkin 118.

The slide guide 84 moves back and forth on the rolling platform 76 to move a slide 86 on the rolling shaft 78. The slide 86 on the rolling shaft 78 is connected to an extender 88 to slide a bar 90 with a set of grooves. The grooved bar 90 rotates a rocker 92 which is connected to a pin that rotates the first fold bar 82 and facilitates rotation of the first fold bar 82 to fold the napkin 118 over the utensils 116 at the bottom corner of the napkin 118. When folded over, the napkin 118 and utensils 116 are to some extent locked onto the rolling tongue 80.

The second fold bar 94, once engaged, further holds the napkin 118 and utensils 116 to the rolling tongue 80. The second fold bar 94 is also rotatable around the rolling tongue 80. When rotated around the rolling tongue 80 the second fold bar 94 catches and pulls the remainder of the napkin 118 tight around the utensils 116 to complete the fold bars 82 and 94 portion of wrapping the utensils 116 in the napkin 118. As explained in further detail and illustrated in FIG. 9B, the second fold bar 94 is rotatable by a motor driven wheel 95 rotating about the rolling shaft 78. The wheel rotates an assembly of spin plates 96 and 98 holding the second fold bar 94 and a spring with lock pin 97. Once the locking spin plate 96 rotates far enough around the rolling shaft 78, the lock pin 97 is pushed via a spring into a hole in the rolling shaft 78 holding the bar 94 in place during rolling, as illustrated in FIG. 9C.

Once the second fold bar 94 has been engaged, the rolling arms 102 engage. The rolling arms 102 engage around the rolling tongue 80 to form essentially a closed cylinder about the rolling tongue 80 to hold the napkin 118 and utensils 116 tight to the rolling tongue 80 while the rolling shaft 78 rotates, as illustrated in FIG. 9D. The rolling shaft 78 may rotate up to five (5) revolutions in order to fully wrap the napkin 118 around the utensils 116 as the size of the napkin and dimensions of the utensils may vary. At the same time, the rolling shaft 78 rotates and wraps the napkin 118 around the utensils 116, a securing band 120 can be fed into the wrapping cylinder and wrapped around the napkin 118 and utensils 116. The securing band 120 may be a paper band or made of any material that is pliable and easily removable when the utensils 116 are to be removed from the napkin 118. The securing band 120 may have an end with pre-applied adhesive and delivered on a continuous roll to the rolling unit 74. As the securing band 120 is also rolled around the wrapped utensils 122, the securing band 120 is sealed to its opposing end and the band 120 is wound tightly around the wrapped utensils 122 to lock the utensil 116 set in the napkin 118.

After the napkin 118 and utensils 116 are rolled and wrapped, a pneumatic cylinder 100 positioned inside the rolling tongue 80 ejects the wrapped utensil 122 into a chute or tube 104. The chute 104 is the passageway from the rolling area 26 to the wrapped utensil 122 dispensing area 28. The fold bars 82 and 94 are then automatically moved back into their first position for rolling subsequent utensils 116 in subsequent napkins 118. Once the napkin 118 has been rolled completely around the utensils 116 and ejected off the rolling tongue 80, the first fold bar 94 slide guide 84 retracts which moves the extender 88. Movement of the extender 88 pushes or displaces a guide pin 99, which disengages the lock pin 97 of the second fold bar 94 to release the second fold bar 94 into its pre-rolling position.

Figure 4C:
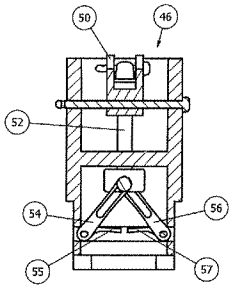
FIG. 4C is an internal rear view of the holding tube as illustrated in FIG. 4B of the present invention.
Figure 4A:
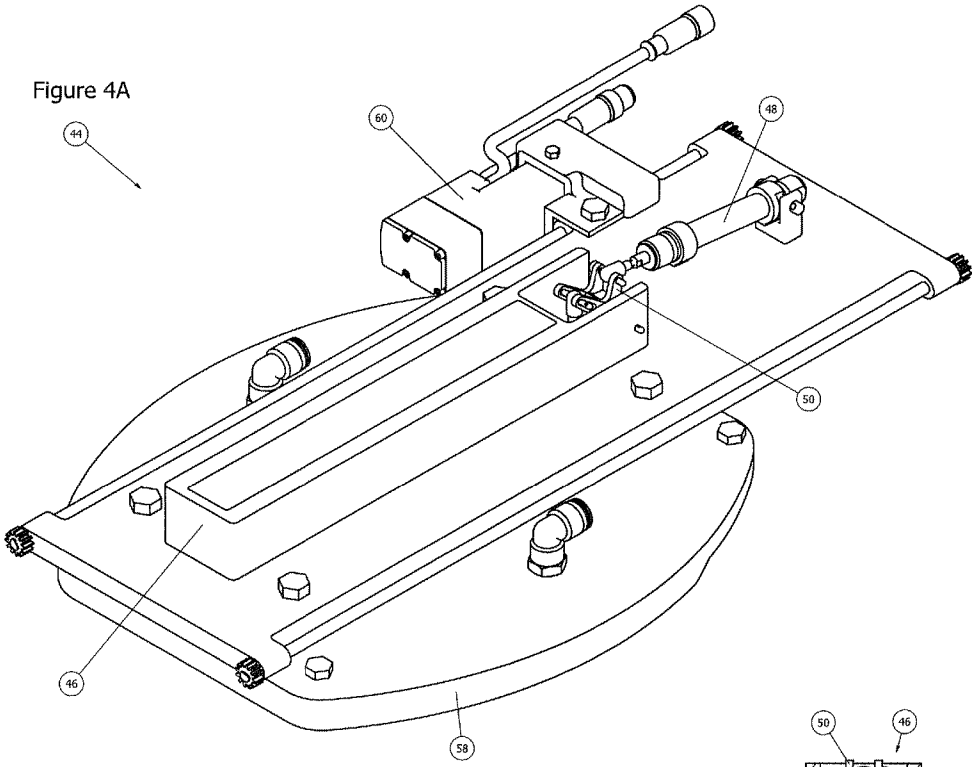
FIG. 4A is a perspective view of an upper transfer unit of the apparatus of the present invention.

As illustrated in further detail in FIG. 10, the lower transfer 106 is a unit which is movable along a track 114 via a motor and gear mount 112. The lower transfer 106 is moveable between a first position and a second position in the direction of arrows 115. The first position is a receiving position, wherein the lower transfer 106 receives the wrapped utensil set 122 from the rolling area 26 via the wrapped utensil chute 104. The second position is a dispensing position, wherein the rolled utensils 122 are dispensed into a selected position of the storage receptacle 22 via a lower transfer placement tube 108. The lower transfer placement tube 108 comprises doors positioned proximate a bottom or lower end of the placement tube 108. The doors can be opened or closed by a piston and/or solenoid 110 extending and retracting; the mechanics of the doors are similar to that of the upper transfer holding tube 46 as illustrated in FIG. 4C. Opening of the doors releases the wrapped utensil set 122 into the receptacle 22 for storing.

The lower transfer unit 106, and the lower transfer placement tube 108 are movable with respect to the storage receptacle 22 to control delivery of wrapped utensils 122 to a selected location for neat and orderly storage. Once the wrapped utensils 122 are released from the placement tube 108, the doors are closed and the lower transfer unit 106 is then moved back to the first position for receiving subsequent wrapped utensils 122 from the wrapped utensil chute 104. A set of utensils 116 can be wrapped quickly; the entire process from loading to storage can be optimally completed in less than six (6) seconds for the first set, and four (4) seconds per set afterwards. The process is quickly repeatable to wrap a plurality of sets of utensils 116 in napkins 118 with a securing band 120 in a more efficient manner.

Although the present invention has been described with reference to preferred embodiments, workers skilled in the art will recognize that changes may be made in form and detail without departing from the spirit and scope of the invention.

What is claimed:

1. An apparatus for automatically wrapping a napkin around a set of utensils, the apparatus comprising:

a housing;

a utensil dispensing unit configured to hold a plurality of utensils and having a floor that is moveable between an extended and retracted position to eject one or more selected utensils such that the utensil dispensing unit is configured to selectively dispense a first utensil and a second utensil different from the first utensil from a utensil loading receptacle to a first transfer unit;

a lift unit for storing a plurality of napkins and configured to automatically deliver a selected napkin to the first transfer unit;

the first transfer unit configured to receive and prepare the first and second dispensed utensils and napkin for rolling and the first transfer unit further configured to automatically deliver the prepared utensils and napkin to a rolling unit and wherein the first transfer unit has a floor comprising a suction plate configured to receive the napkin from the lift unit and to provide the napkin to the first transfer unit and wherein the first transfer unit is movable from a loading position to a dispensing position aligned with the rolling unit;

the rolling unit for wrapping the first and second dispensed utensils in a napkin, the rolling unit configured to receive the utensils and napkin from the first transfer unit, retain the utensils and further configured to wrap the napkin around the utensils wherein the rolling unit comprises a number of wheels forming a rolling cylinder around a rotatable folding mechanism, wherein the rotatable folding mechanism comprises a first fold bar and a second fold bar configured to fold a first and second portion of the napkin over the utensils wherein the folding mechanism rotates inside the rolling cylinder to complete the wrapping and securing of the utensils in the napkin; and a second transfer unit configured to automatically receive wrapped utensils from the rolling unit wherein the second transfer unit is also movable from a loading position to a dispensing position.

2. The apparatus of claim 1 and further comprising a first container for storing a plurality of utensils, the first container configured to provide the utensils to the utensil dispensing unit.

3. The apparatus of claim 1 and further comprising a second container for storing utensils wrapped in a napkin wherein the second transfer unit is further configured to automatically deliver the wrapped utensils to the second container.

4. The apparatus of claim 1 wherein the first transfer unit further comprises a chute configured to deliver each utensil from the dispensing unit to the rolling unit.

5. The apparatus of claim 1 wherein the first fold bar and the second fold bar are rotatable.

6. The apparatus of claim 1 wherein the folding mechanism further comprises an ejector piston to remove the wrapped utensils from the folding mechanism and rolling unit.

7. The apparatus of claim 6 wherein the folding mechanism is further configured to release the wrapped utensils and deliver them to the second transfer unit for selective release of the wrapped utensils into a second storage container.

8. The apparatus of claim 1 wherein the housing further comprises a plurality of ground engaging wheels such that the apparatus is movable.

* * * * *